United States Patent [19]

Pardue, Jr. et al.

[11] 4,290,245

[45] Sep. 22, 1981

[54] EARTH ANCHOR

[75] Inventors: James I. Pardue, Jr., Birmingham; William M. Hornsby, Hueytown; Henry J. Noble, III, Birmingham, all of Ala.

[73] Assignee: Dixie Electrical Manufacturing Company, Memphis, Tenn.

[21] Appl. No.: 89,446

[22] Filed: Oct. 30, 1979

[51] Int. Cl.[3] ..... F02D 5/74

[52] U.S. Cl. ..... 52/157; 52/165; 52/686

[58] Field of Search ..... 52/157, 165, 681, 685, 52/679, 686

[56] References Cited

U.S. PATENT DOCUMENTS

| | | | |
|---|---|---|---|
| 1,791,368 | 2/1931 | Mullett | 52/157 |
| 2,380,692 | 7/1945 | Gunnison | 52/166 X |
| 2,772,560 | 12/1956 | Neptune | 52/685 X |
| 3,830,315 | 8/1974 | Love | 52/157 X |
| 3,871,142 | 3/1975 | Abbott | 52/157 X |

FOREIGN PATENT DOCUMENTS

| | | | |
|---|---|---|---|
| 753130 | 2/1967 | Canada | 52/157 |
| 835021 | 2/1970 | Canada | 52/157 |

*Primary Examiner*—Carl D. Friedman
*Attorney, Agent, or Firm*—Paul M. Denk

[57] ABSTRACT

In an earth anchor for use for embedding within the ground and to acquire a secure and snug retention therein, the anchor incorporates a shank portion having a helical blade affixed thereto, the blade having a linear cutting edge positioned at a lagging angle off the perpendicular or radius from the said shank portion; said shank portion may contain one or more of the helical blades spacedly arranged there along, or have a series of shank portions that are connectible axially together to form an anchor of greater length. An end cap is designed for mounting onto the upper end of an anchor, and having reinforcing rods secured thereto, and which may act as reinforcement for a concrete pile, foundation, or the like, as poured thereon, with the anchor providing a firm base for this type of constructed structure.

9 Claims, 10 Drawing Figures

EARTH ANCHOR

BACKGROUND OF THE INVENTION

This invention relates generally to anchoring means, and more particularly pertains to a multipurpose anchor for providing permanent fixation within the ground.

Numerous styles of screw anchors, or other types of anchoring means, have long been available in the art, and most of these anchors are designed for being either manually, but preferably powered by a tool for turning into secure confinement within the ground. Many of these anchors have their own particular style of helical blade for accomplishing their own sought for results, and perhaps each of these prior art anchors do attain that result for which they were originally intended to perform.

The U.S. patent to Jahnke, U.S. Pat. No. 3,793,786, discloses a type of screw anchor where its lower end is formed having a screw type of shank, with a helical flight of blade arranged thereabove to supplement the digging action of the said shank. It is to be noted that the leading cutting edge of the helical flight for the blade of this patent is arranged significantly at a perpendicular angle radially away from its shank.

The U.S. patents to Roza, U.S. Pat. Nos. 3,645,055, and 3,662,436, in addition to the U.S. patents to Petres, U.S. Pat. No. 3,828,562, and the additional Jahnke U.S. Pat. Nos. 3,832,860 and 3,832,861, disclose methods and apparatus for installing anchors, but the particular style of anchors shown are what are identified as helical screw type blades that are connectible with and have leading edges that blend into their hub portion and expand in width therefrom, then exhibiting an extending elongated portion formed at the upper end of the helix. This particular style of helical formed cutting blade, and its connection with the shank portion of the screw anchor, is more clearly shown in detail in the U.S. patent to Petersen, U.S. Pat. No. 3,016,117. There apparently are certain advantages to be attained from a screw anchor having a cutting edge that is arculate in shape, and curves around its shank portion from its leading edge.

Similar type anchors are shown in the U.S. patents to Smith, U.S. Pat. No. 1,193,725, Bash, U.S. Pat. No. 1,883,477, Dray, U.S. Pat. No. 1,388,031, Maloney, U.S. Pat. No. 1,283,246, and Widmer, U.S. Pat. No. 816,631.

While all of the foregoing prior art anchors are probably effective for their intended purpose, the current invention is designed to provide a modification to what is disclosed in the prior art, and that is to form a linear cutting edge at a lagging angle with respect to the radius or perpendicular from its mounting shank portion, and thereby provide a length of cutting edge that is more effective in providing for the bite or slice of the anchor into the ground, and at the same time, because of its designed lag angle, effectively urges any rock or other debris encountered in the ground further laterally for eventual movement outside of the perimeter of its helical blade.

It is, therefore, a principal object of this invention to provide an earth anchor that effectively sheds any rock or other debris encountered by its leading edge during its turning into the ground, without detracting from the effectiveness of its linear cutting edge to dig into the ground during progressive turns of its shank.

Another object of this invention to provide an earth anchor that disposes its cutting edge along a lagging angle from the shank portions radius so as to enhance the slicing effect of its helical blade while digging into the soil during a turning of said anchor.

Another object of this invention is to provide an angularly oriented linear cutting edge for an earth anchor that effectively sheds rock to the side without any deleterious damage to its cutting edge, the structural configuration of its helical blade, or supporting shank portion.

Yet a further object of this invention is to provide an earth anchor that may incorporate a series of spacedly arranged integral helical blades along the length of the shank portion of said anchor, and significantly enhance the holding power of the anchor to the ground.

Yet another object of this invention is to provide connecting means for attaching a series of shank portions of an earth anchor together so as to provide an anchor of infinite length, or to that length called for in the design and as desired for the particular installation.

Still another object of this invention is to furnish an earth anchor having an end cap, and which cap may incorporate a series of secured reinforcing rods that may form the basis, with the earth anchor for supporting a concrete pile or foundation.

Still another object of this invention is to provide an earth anchor that may be easily assembled, and quickly embedded into the ground through the use of conventional power equipment.

These and other objects will become more apparent to those skilled in the art upon reviewing the summary of this invention, and upon undertaking a study of its preferred embodiment in view of the drawing.

SUMMARY OF THE INVENTION

This invention contemplates the formation of a particularly styled earth anchor, of the type that is designed for forceful embedment within the ground. And, an anchor of this nature has multiple uses, can be applied as a means for attachment of guy wire for support of a telephone or other type of pole as balanced with respect to the ground, to be used as an anchor for deep embedment within the ground, or to be used in the nature of a helical pile for supporting concrete piles or foundation, or for other similar purposes. In addition, and to facilitate the efficient usage of this earth anchor, particularly when it is being turned or driven into the earth, the helical blade of the anchor incorporates a linear slicer or cutting edge, and which edge is arranged at a lag angle from the radius of the shank to which the blade is integrally attached. In this manner the blade effectively slices into the ground as the anchor is being forcefully turned through the use of associated power equipment, and due to the cutting edge of the blade being arranged upon an incline with respect to the shank with which it turns, it conveniently slices into the ground along its sharpened leading edge. Furthermore, because of the lag angle between the blade cutting edge and the radius from the shank portion to which it mounts, any debris, rock, or other material that retards the effective digging of the anchor into the ground, during its installation, is conveniently shoved to the side as a result of the rearward incline of the linear blade edge with respect to its turning shank portion.

In order to provide for the effective use of this anchor in those positions where significant forces are required to resist the pull of tension as exerted upon the anchor after its installation, a series of two or more of the anchors may be coupled together, so as to provide an anchor of infinite length, or at least to that sizable length previously researched as being required to resist the forces to be applied upon the anchor after its embedment. In addition, and as previously briefly alluded to, the anchor of this invention may be used as undersupport for pilings, foundations, or related type of construction structures. To achieve this, an end cap is provided for the upper end of an emplaced anchor, and the cap has welded or otherwise secured thereto a series of laterally arranged reinforcing bars, so that when concrete may be poured into the foundation cavity dug into the earth, with the anchor having been embedded into its bottom, and having its cap and reinforcing bars extending slightly upwardly therefrom, such concrete as poured therein envelopes such reinforcement with the anchor providing further support to the building foundation being formed.

Various tests have been conducted to determine the holding power of the earth anchor of this design, and the following chart discloses the relationship between the foot pounds of torque necessary for driving the identified anchors into the ground, and the amount of holding strength in compression that can be resisted by the anchor after its installation. The D figure refers to the design number of the anchor being tested, and also provides its diameter range.

TORQUE VS BEARING STRENGTH FOR EARTH ANCHORS HOLDING STRENGTH IN COMPRESSION/LBS.

| FT/LB TORQUE | D-126632 8"-10" | D-126636 8"-10"-11.3" | D-126637 10"-11.3"-13.5" | D-126638 10"-11.3"-13.5"-15" |
|---|---|---|---|---|
| 3000 | 25,500 | 26,700 | 26,900 | 30,400 |
| 4000 | 28,100 | 34,700 | 35,600 | 41,200 |
| 5000 | 32,600 | 42,600 | 44,300 | 52,000 |
| 6000 | 37,100 | 50,400 | 52,400 | 62,800 |
| 7000 | | 58,300 | 61,000 | 73,700 |
| 8000 | | 63,200 | 66,000 | 84,500 |

The foregoing provides a summary of the general utilitarian and structural aspects of this invention, while the following renders a description of the preferred embodiment of the earth anchor in structure, and in its various modified forms.

BRIEF DESCRIPTION OF THE DRAWING

In the drawing, FIG. 1 provides isometric view of the earth anchor of this invention.

DESCRIPTION OF THE PREFERRED EMBODIMENT

Figure 1:
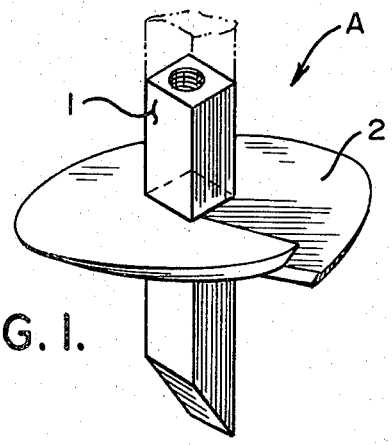
Figure 2:
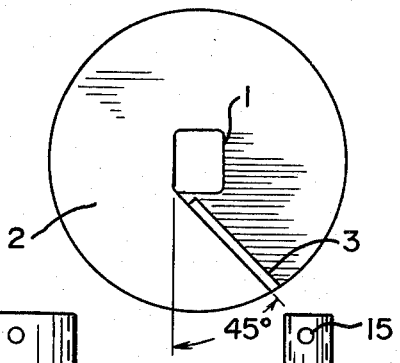
FIG. 2 furnishes a plan view of the earth anchor of this invention, as shown in FIG. 1.
Figure 3:
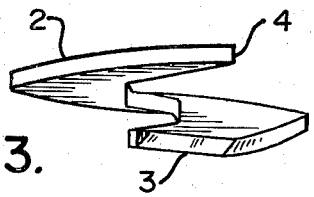
FIG. 3 furnishes a side view of the helical blade for the earth anchor of this invention.

In referring to the drawing, and in particular FIGS. 1 through 3, there is shown the basic configuration for the earth anchor A of this invention, and which incorporates a shank portion 1 having a helical blade 2 secured therewith. The helical blade, in the preferred embodiment, is designed to different sizes, and can be as small as four inches in diameter, or extend in width to approximately fifteen inches or more in diameter. And, depending upon the size of the blade for the anchor, the thickness of metal used in the formation of the blade can vary between $\frac{3}{8}$ inch thick for the smaller sizes, and up to $\frac{1}{2}$ inch thick material for the larger diameter anchor. Obviously, other sizes than those stated can be employed. Generally, the pitch between flights for the leading cutting edge 3 to its trailing edge 4 is always somewhere in the vicinity of three inches, so as to provide sufficient clearance for the earth being cut to pass between these spaced edges, and at the same time to furnish that pitch to the leading edge of the blade that provides for a smooth transition in its cut into new soil, preferably without binding or exerting too great of a stress upon the blade, and to at least dig in sufficiently into the earth so as to make some headway for the anchor as it turns into the ground.

The unique feature of this invention is shown more specifically in FIG. 2, and therein it can be seen that the leading cutting edge of the helical blade is formed of a linear design, as shown at 3, with said cutting edge being beveled, on approximately a 30° bevel, down to its sharpened edge, so as to assure a constant penetration into the earth as the anchor is forcefully turned. And as shown, a significant lag angle is formed between the radius from the shank portion 1, in its attachment with the frontal tangent of the said shank portion, so that this cutting edge may conveniently sever the earth in a slicing fashion as the anchor is turned forcefully into the same, while at the same time, should any debris, rock or related type obstacle be encountered by the blade during its turning, there is a good likelihood that such material will gradually be urged outwardly of the blade, beyond its perimeter, and be cleared due to the presence of this lag angle designed into the positioning of its cutting edge for the helical blade. As can be seen, this angle may be in the vicinity of 45° as shown, although angles to a slightly lesser angular degree may yet work sufficiently effective for the anchor of this design during its application.

It is also to be noted of some importance that this leading cutting edge 3 of the anchor is of the identified linear design, provides a length of cutting edge for cutting directly into the ground, and is quite distinct from those cutting edges normally employed upon the helical type anchor where the cutting usually is formed along an increasing radii as the blade extends away from its supporting shank, particularly as shown in the identified prior art as previously analyzed.

Figure 4:
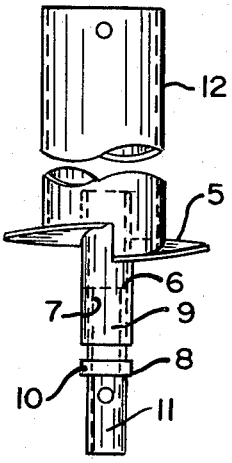
FIG. 4 provides a partial elevational view of a top section of the earth anchor of this invention, having a coupling means securing into its bottom end.

Various modifications and structural embodiments to accomodate varying usages of the anchor of this invention have been designed, and all of these modifications are intended to compliment the usage of the basic anchor depending upon its type of application. For example, and as shown in FIG. 4, the anchor section to be seen in this design comprises the helical blade 5, of the identical design as previously analyzed, having its shank portion 6 extending downwardly therefrom. The lower end of the shank portion incorporates an internal cavity, as at 7, and into which a coupling means 8 may be inserted and affixed by means of a pin (not shown) that may slidingly insert through both the said portion 6 and the reduced diameter part 9 that fits within the cavity 7 of the anchor. A collar 10 separates the reduced portion 9 of the coupling means from its further reduced portion 11 arranged downwardly therefrom, and the collar is designed to act as a spacer between anchor portions that are actually fitted together so as to increase the length of the anchor, all which depends upon the nature of use of the anchor, and the force that it has been designed to accommodate, whether it be a tension or compression type of load. For example, if the anchor is to fix a guy wire from a utility pole to the ground, obviously the force to be applied thereon is always in the nature of a tension force, whereas should the anchor be used to act as a support for a pile, then naturally compressive forces will always be exerted upon the same. The anchor has also been designed, as for example as seen in the data set forth in the summary of this invention, for holding this strength in compression, as when the anchor is used in support of a pile or other foundation, and must carry a significant weight in compression.

The upper part 12 of the earth anchor as shown in FIG. 4 is of slightly increased diameter, and functions in the nature of an upper terminus for the said anchor. Usually, some form of an end cap, as will be subsequently described, will be mounted and fastened to the upper end of this part 12 so as to cap off the anchor after it has been affixed into the ground.

Figure 5:
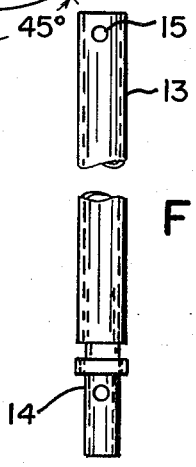
FIG. 5 furnishes a partial elevational view of an extension portion for the earth anchor of this invention having a coupling means securing to its lower end.

Another attribute of this invention is the linking of anchor sections together, and more specifically the connection of the shank portion of one anchor with another, so as to increase the length of the earth anchor, and add to the number of helical blades to be embedded within the ground, all for the purpose of enhancing the strength retention factor of the anchor when installed. And, in certain instances, it may be desirable to utilize linking members or extensions between anchors, and such is shown in FIG. 5. In this embodiment, the plain extension 13 is shown, having a coupling means 14 as previously described connecting into its bottom end, which has a hollow cavity therein, as previously analyzed, while the upper end of the linking member or extension is designed in similar fashion, having an aperture, as at 15, provided therethrough, into which one of the pin means (not shown) as previously described may insert through, and also through any coupling means inserted therein, so as to lock the coupling means and the extension together.

Figure 6:
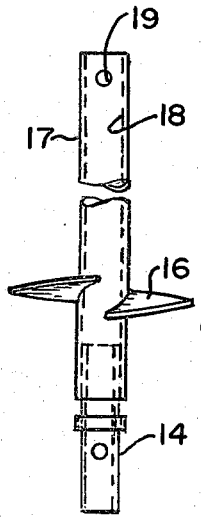
FIG. 6 provides a partial elevational view of an earth anchor section of this invention, having a coupling means being securing to its lower end.

Various lengths of helical extensions incorporating the blade 16 of this invention have been designed, and are conveniently provided for linking together so as to form the length of anchor as previously described. Such is shown in FIG. 6, and it can be seen that each extension 17, or length of its shank portion has at least one helical blade integrally secured thereon, with the blade being of the design as previously described with respect to prior figures analyzed in this disclosure. The upper end of the portion 17 contains a hollow cavity therethrough, as at 18, with an aperture 19 formed through its walls so as to accommodate in a connecting fashion one of the coupling means 11 and 14 as previously described. A locking pin, as stated, inserts therethrough for holding these two members together. The bottom end of the shank portion 17 also has a cavity formed therein, or this cavity, as at 18, may extend all the way through the shank portion as can be seen. But, in those designs where it is desirable to add to the reinforcement of the anchor, these cavities may be only to that depth that will accommodate the parts 9 or 11 of the coupling means therein, with the rest of the shank being of solid configuration so as to enhance their strength, and increase their ability to withstand the significant foot-pounds of torque that are exerted upon them while turning of an anchor forcefully into the ground.

Figure 7:
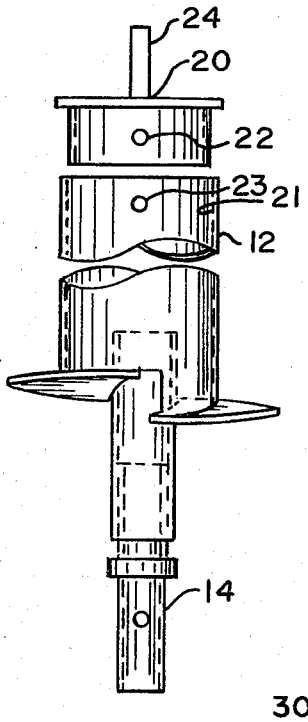
FIG. 7 discloses a partial elevational view of the top section of an earth anchor of this invention, having an end cap being mounted into its upper end, while a coupling means is securing to its lower end.

As can be seen in FIG. 7, the earth anchor of this design is very similar to that which was previously described in FIG. 4, but that the end cap 20 is shown in its relationship where it can slidably insert into the cavity 21 provided within the member 12, and therein be secured by means of a pin or other fastening means through the series of apertures 22 and 23 for rigidly securing said cap onto its anchor. The cap may include a lug or other form of integral eyelet 24 and through which a cable connection may be made as when the anchor is readied for usage.

Figure 8:
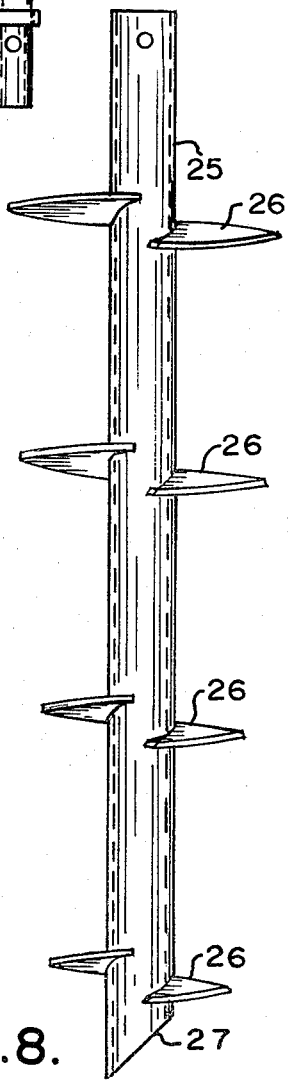
FIG. 8 discloses a modification to the earth anchor of this invention wherein a shank portion contains a series of spacedly mounted helical blades along its length.

A further modification to this invention is shown in FIG. 8, wherein the shank portion 25 is of some length, and contains a series of spacedly arranged helical blades 26 along its length. Thus, an anchor of this design may be turned forcefully into the ground, and rigidly hold therein due to the multitude of blades that grasp the ground in which the anchor is inserted so as to secure it and function to withstanding excessive compression or tension forces depending upon the application of this anchor. And, the bottom of the anchor may be pointed, as at 27, so as to facilitate the initial penetration of the anchor into the ground and at least to that depth where the lower helical blade can initiate digging and penetration of the ground during the anchor's turning by means of a motor, vehicle, or the other usual instrumentation used to achieve such. And, should additional heighth be desired for the anchor shown in FIG. 8, then other extensions, such as those shown in either FIGS. 4, 5, 6, or 7 may be connected onto the top of the shank portion 25 of the anchor shown so as to lengthen it to that length desired and previously determined to meet design parameters and as necessary to furnish the type of anchor support required for the particular situation encountered. Hence, a plurality of earth anchor extensions as shown in FIG. 6 may be actually linked together, onto the top of the anchor shown in FIG. 8, before one of the end cap sections as previously explained in FIG. 4 or 7 are connected to furnish the upper terminus for the fabricated anchor.

Figure 9:
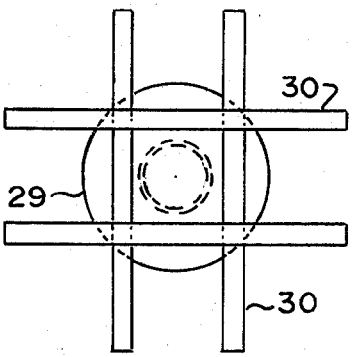
FIG. 9 provides a plan view of the upper end cap of the earth anchor of this invention having reinforcing rods connected therewith.
Figure 10:
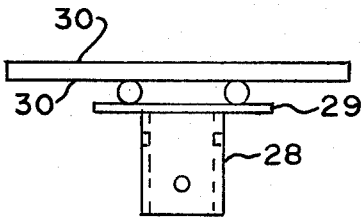
FIG. 10 furnishes a side view of the upper end cap supported reinforcing rods for the earth anchor of this invention.

Another modification to the anchor of this invention as shown in FIGS. 9 and 10, and this particular style of structure is intended as a replacement for the type of end cap 20 previously analyzed in FIG. 7. In this particular design, the end cap 28 has an integral upper plate 29, as previously shown, and instead of having a lug connected thereon, a series of reinforcing or other rods 30 are welded or otherwise connected thereupon so that the end cap when emplaced upon the embedded anchor disposes its rods preferably approximate to the bottom of the cavity into which concrete is to be poured for forming a foundation, footing, or even a concrete pile for a more larger building structure. While heretofore it was of customary design to drive wood piling into an excavated site for providing support for the foundation of a building, it can be seen from the data chart depicting the compressive forces to be withstood by the earth anchors therein identified that such anchors can easily replace the customary wood pilings. The reason for this is that the helical blades of the anchor provide significant holding force for the same when embedded within the ground, whereas the wood pilings normally driven into the ground contain no such means for resisting movement of the soil after its emplacement. And, once the earth anchor as used as a helical pile through the teachings of this invention is located, then one of the modified end caps 28 having the integral reinforcing bars thereon may be located upon the upper end of the embedded anchor, and therein function to act as a means for retention of the poured concrete and to provide a footing in and of itself for the concrete foundation, footing, or other piling as poured thereon.

Other modifications to the earth anchor of this invention may occur to those skilled in the art upon reviewing this subject matter of this disclosure. Any such modifications, if within the spirit of this invention, are intended to be encompassed within and protected by any claims to patent protection issuing hereon. The description of the preferred embodiment as set forth herein is done so for illustrative purposes only.

Having thus described the invention, what is claimed and desired to be secured by Letters Patent is:

1. An earth anchor for use for embedment within the ground and for resisting pulling or compressing forces tending to urge the anchor from its implanted position, comprising, a shank portion, a continuous helical blade extending approximately a full circumference and affixed to said shank portion and designed for cutting into the ground upon anchor application, said blade having a singular linear cutting edge at the lowest extent of its flight, said linear cutting edge extending at a lagging angle from the perpendicular to the shank portion and further extending tangentially from its frontal portion thereof for effectively displacing any debris encountered by the cutting edge outwardly of the blade's circumference, said linear cutting edge lagging the perpendicular from the shank portion by an angle at least thirty degrees, and said linear cutting edge of the helical blade being bevelled downwardly for facilitating its cutting into the ground upon anchor application.

2. The invention of claim 1 and wherein there are at least a pair of shank portions each having at least one integral helical blade, and a coupling means interconnecting said shank portions together.

3. The invention of claim 2 and wherein one of each shank portions has a cavity formed at least axially into its lower end, the other shank portion having a similar cavity formed axially at least into its upper end, and said coupling means inserting into said cavities and affixing said shank portions together, and pin means inserting through each shank portion and the coupling means for fastening said members together.

4. The invention of claim 3 and including an end cap affixing upon the cavity of the upper most shank portion.

5. The invention of claim 4 and wherein said end cap includes an integral lug.

6. The invention of claim 1 and wherein there are at least a pair of said helical blades integrally secured spacedly along the length of a shank portion.

7. The invention of claim 1 and wherein said shank portion and integral blade form a helical pile.

8. The invention of claim 7 and including an end cap fitted upon the upper end of the said shank portion, and rod means connecting onto said end cap and projecting laterally therefrom for functioning as reinforcing rods for any concrete poured thereupon.

9. An end cap for an earth anchor of the type having a shank portion and an integral helical blade, said earth anchor being of the type for embedment within the ground and disposing its end cap at the vicinity where a concrete foundation or other structure is to be poured, said end cap having a sleeve-like member for fitting upon the upper end of the said shank portion of the earth anchor, a plate integrally affixed to the upper end of said sleeve-like member, means for securing said sleeve-like member to the earth anchor shank portion, means provided upon the upper surface of the plate for securement of reinforcing means thereto, said means comprising a series of reinforcing rod means rigidly secured with the said plate and designed for reinforcing and adhering any poured concrete rigidly upon and to any embedded earth anchor.

* * * * *